United States Patent [19]

Mons et al.

[11] 4,423,097

[45] Dec. 27, 1983

[54] ABRADABLE SEAL AND ITS METHOD OF PRODUCTION

[75] Inventors: Claude M. Mons, Savigny Le Temple; Michel J. Pernot, Fontenay Sous Bois; Roland R. Spinat, Bretigny Sur Orge, all of France

[73] Assignee: Societe Nationale D'Etude Et De Construction De Moteurs D'Aviation "S.N.E.C.M.A.", Paris, France

[21] Appl. No.: 387,818

[22] Filed: Jun. 14, 1982

[30] Foreign Application Priority Data

Jun. 12, 1981 [FR] France ..... 81 11564

[51] Int. Cl.[3] ..... B05D 1/10

[52] U.S. Cl. ..... 427/423; 75/252; 75/254; 428/406; 428/325; 428/639; 277/96.2

[58] Field of Search ..... 428/406, 325, 639; 277/96.2; 75/252, 254; 427/423

[56] References Cited

U.S. PATENT DOCUMENTS

| | | | |
|---|---|---|---|
| 3,084,064 | 4/1963 | Cowden . | |
| 3,547,455 | 12/1970 | Daunt . | |
| 3,575,427 | 4/1971 | Lapac . | |
| 4,177,308 | 12/1979 | Beeler . | |
| 4,248,940 | 2/1981 | Goward | 427/423 X |
| 4,330,575 | 5/1982 | Litchfield | 75/252 X |

FOREIGN PATENT DOCUMENTS

| | | |
|---|---|---|
| 1251500 | 12/1960 | France . |
| 1565344 | 3/1969 | France . |
| 2048433 | 3/1971 | France . |
| 2256125 | 7/1975 | France . |
| 2056502 | 3/1981 | United Kingdom . |
| 2072222 | 9/1981 | United Kingdom . |

*Primary Examiner*—Shrive P. Beck

*Attorney, Agent, or Firm*—Oblon, Fisher, Spivak, McClelland & Maier

[57] ABSTRACT

A seal intended to wear from abrasion for use in contact with a rotor zone of a rotating machine, of thetype made up of a dispersion of hollow microspheres in a binder providing cohesion of the microspheres among themselves and their attachment to a metallic support. In order to make it possible to produce the seal by torch spraying from a powdered mixture onto the support, the hollow microspheres are made of an inorganic refractory material and the binder material is a metallic material more fusible than the material of the microspheres.

13 Claims, 2 Drawing Figures

ABRADABLE SEAL AND ITS METHOD OF PRODUCTION

BACKGROUND OF THE INVENTION

1. Field of the Invention

The invention relates to an air seal that is intended for abrasion wear due to contact with a rotor zone of a rotating machine in order to achieve relative sealing. These seals are characteristically placed around movable blades of the rotor stages of axial turbine engines in order to eliminate air or gas leaks which can affect the performance of these stages.

The seal in this invention is of a type consisting of a dispersion of hollow microspheres in a binder which holds the spheres together and provides the connection between them and a metal support (which, for example, may be a ring in the machine). The invention also relates to the method of producing the seal and the powdered mixture used to carry out the method.

2. Description of the Prior Art

The French Pat. No. 1,565,344 describes an abradable seal of the type discussed above in which the hollow microspheres are made of an aluminum alloy containing at least one metal of the iron, nickel and cobalt group, while the binder is advantageously a brazing alloy containing at least one metal of the group made up of copper, nickel and silver. The seal is created, for example, by depositing a mixture of the spheres and an alloy binder powder on the support (which may consist of a honeycomb core whose cavities are filled by the mixture) and by heating this composite material to a convenient temperature.

However, this prior art joint has several disadvantages. First, it was necessary to use for the microspheres a material which was able to be wetted by the brazing and to use a brazing which would fuse at a temperature below the melting point of the microspheres and the support. This requirement limited the range of the useable brazing alloys and consequently the possible ways to employ the seal. These constraints in the choice of materials prevented submitting the support, after applying the seal, to thermal treatments (for example annealing or stress relieving) due to the risk of damage to the brazing. Moreover, making the seal required heating the support and maintaining it at a precise temperature in an atmosphere whose composition is controlled. The prior art patent mentioned above indicates that, in effect, the microspheres cannot withstand torch (flame) spraying, and that this procedure is thus not suited for making the joint.

SUMMARY OF THE INVENTION

In contrast, the invention makes it possible to produce joints or seals of the type mentioned above having the following advantages. First, the materials of the hollow microspheres and the binder can be selected from an extensive and varied range of compositions of such a type that the characteristics of the joint can be easily adapted to particular service conditions. Second, the binder can have a composition that is compatible with that of the support (for example, both of them can be made of an iron and/or nickel, and/or cobalt base, with or without chrome) and various thermal treatments can be applied to the support without harming the binder. Finally, producing the joint is easy and rapid.

The invention is based on the fact that there are now hollow microspheres commercially available made of refractory materials capable of withstanding, without deformation or notable fragmentation, the mechanical stresses caused by torch spraying (plasma or oxy-acetylene gun torch).

According to the invention, the joint, which, in use, is worn down by abrasion, consists of a dispersion of hollow microspheres in a metal matrix that is fixed to a metal support. The hollow microspheres are made of an inorganic refractory material whose melting point is higher than the melting point of the support material and of the matrix material. Metal matrix here means a metal alloy matrix or an intermetallic composition. Advantageously, the matrix material can have the same base constituents as the alloy forming the support.

The procedure according to the invention for producing the joint of the invention consists of the following steps. A homogenous mixture in proper proportions of a powder composed of hollow microspheres and a powder of metallic grains having the desired composition for the matrix is prepared. The mixture is then torch sprayed onto the support under operating conditions such that the metallic grains are bonded together with the microspheres and with the support without deformation or notable fragmentation of the hollow microspheres. Hollow microspheres here mean hollow sphericules whose diameter is no more than 200 microns.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
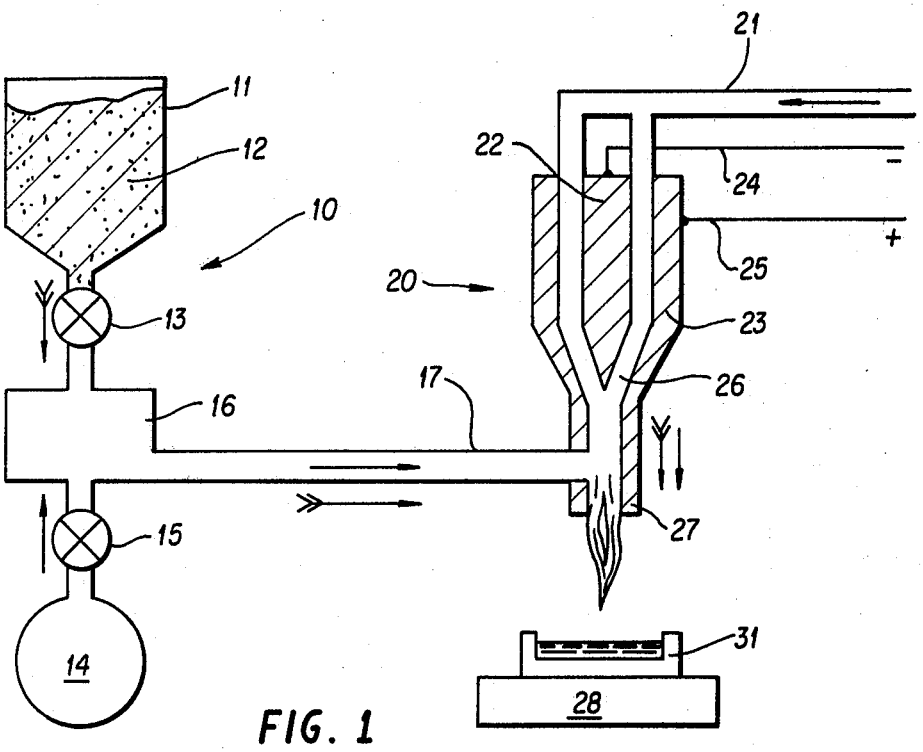
FIG. 1 is a schematic drawing of an apparatus for producing the abrasion wear joint according to the invention.

FIG. 1 schematically shows an installation for projecting the powder by means of a plasma torch of a known type. Only the essential elements are shown. The finned arrows show the direction of the sprayed powder and the unfinned arrows show the direction of th- gas circulation. FIG. 1 does not show, for example, the automatic control devices, the vibrators, etc., which can be used with such an apparatus.

The supply device 10 includes a powder reservoir 11 which contains a mixture 12 of microsphere powder and the matrix alloy grain powder, and whose outlet flow is controllable by means of a gate valve 13. A fluidization gas reservoir 14 (e.g. argon) has an outlet whose flow is controllable by means of a gate valve 15. A fluidization chamber 16 is connected to reservoirs 11 and 14 for fluidizing the mixture 12, and delivers a suspension of powder mixture carried by the gas through line 17 to the plasma torch 20.

The plasma torch 20 includes an inlet tube 21 for the projection gas (e.g. argon). Two cylindrical concentric electrodes 22 and 23 are maintained at a high potential difference by means of leads 24 and 25 connected to a high voltage direct current power source (not shown). The electrodes delimit an annular jet 26 in which the plasma forms. A spraying nozzle 27 is supplied with plasma by the jet 26 and with a fluidized mixture by the tube 17.

The support 31 of the joint being formed is bounded to attachment and driving elements 28, such as platens, rollers, etc. which make it possible to convey to the support 31, in cooperation with the control means associated with the torch 20 (not shown), all those relative translation or rotation movements necessary to form the joint. The installation in FIG. 1 can be very easily automated. Furthermore, should the nature of the material of the joint allows it, the plasma torch 20 can be replaced by any other hot spraying device such as an oxy-acetylene gun.

Figure 2:
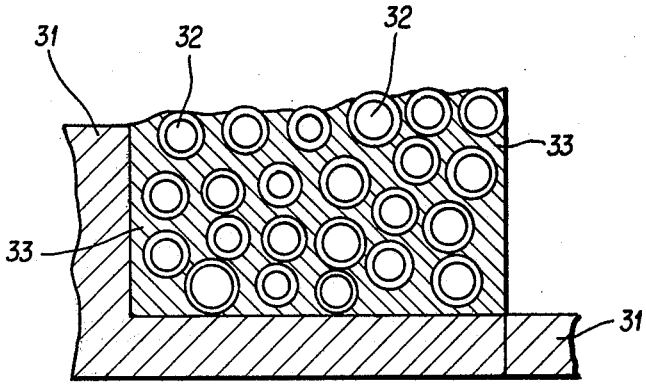
FIG. 2 is an enlarged section of the manufactured joint.

FIG. 2 shows the structure of the resulting joint. The matrix 33, forming a binder, adheres closely to the metal support 31 and fixes the hollow microspheres 32. The dimensions of these latter have been greatly exagerated in relationship to the thickness of the joint, which is greatly enlarged as well.

It is advantageous, but not imperative, to use, if possible, a binder powder whose composition is similar to that of the joint support material (machine ring for example) in order to obtain a matrix of binder fixed to the support and endowed with the same thermal expansion coefficient. This eliminates differential stresses of thermal origin.

In a turbojet engine, the metal material of the binder powder may vary from the BP compressor to the HP turbine. Preferably, the binder powder is first made of pure aluminum or an aluminum alloy, then of a nickel-chrome alloy, nickel-chrome-aluminum or nickel-aluminum, then of a cobalt-chrome-aluminum-yttrium alloy or nickel-chrome-aluminum-yttrium, finally of a metallic ceramic of the magnesium zirconate type, or any mixture of metallo-ceramic powders.

With respect to the hollow microspheres, it is essential that they should be strongly resistant to mechanical and thermal stresses caused by the spraying step and that they be chemically inert vis-a-vis the matrix and the gas used for spraying. They can be formed of a refractory ceramic such as alumina, a silicate of aluminum, a residue of coke, etc. They must, however, be sufficiently fragile to be fragmented by the action of the rotating elements in contact with the joint without eroding said elements and without escaping from the matrix. Their diameter may vary from 10 to 200 microns. The thicker the seal, the larger the diameter of the spheres may be. Regarding the proportions of the mixture used in the spraying apparatus, it appears that the best results are obtained when the proportion of the microspheres in the mixture ranges from 50 to 90%, volume wise.

The phenomena occurring in the spraying operation are extremely complex and the operating parameters (support temperature and flow rate of the spray) may only be determined by experimentation. These parameters depend in effect not only on the dimensions of the hollow microspheres, their fusion temperature (melting point) and the fusion temperature of the binder, but also on the calorific characteristics of these elements, such as their calorific capacities, their thermal conductivity and diffusibility coefficients, or their chemical reactivity.

Obviously, numeral modifications and variations of the present invention are possible in light light of the above teachings. It is therefore to be understood that within the scope of the appended claims, the invention may be practiced otherwise than as specifically described herein.

What is claimed as new and desired to be secured by Letters Patent of the United States is:

1. A method for producing a seal consisting of a dispersion of hollow microspheres in a binder and fixed to a support, said method comprising:

forming a mixture of binder material powder and hollow microspheres made of an uncoated inorganic refractory material, said binder powder being fusable at a temperature lower than the melting temperature of said microspheres;

transporting said mixture to a spraying torch; and using said torch to heat and project said mixture onto said support such that said binder powder is fused and bonded to said micropsheres and said support, and such that said microspheres are not substantially deformed and fragmented.

2. The method according to claim 1, wherein the diameter of said hollow microspheres is between 10 and 200 microns.

3. The method according to claim 1 or claim 2, wherein the material of said hollow microspheres is at least one from a group consisting of alumina, aluminum silicate and carbon.

4. The method according to claim 1, wherein the binder material is at least one from a group consisting of an alloy of a nickel and cobalt.

5. The method according to claim 4, wherein the binder material also contains chrome.

6. The method according to claim 4 or claim 5, wherein the binder material also contains aluminum.

7. The method according to claim 6, wherein the binder material also contains yttrium.

8. The method according to claim 1, wherein the binder material is ceramic.

9. The method according to claim 8, wherein the binder material is magnesium zirconate.

10. The method according to claim 1, wherein the binder material is a metallic alloy having the same base constituents as the alloy of the support.

11. The method according to claim 1, wherein said spraying is performed by means of a plasma torch.

12. The method according to claim 1, wherein said spraying is performed by means of an oxy-acetylene gun.

13. The method according to claim 1, wherein the microspheres are present in said mixture in a proportion by volume of 50 to 90%.

* * * * *